United States Patent [19]

Holmes

[11] 4,327,902

[45] May 4, 1982

[54] COAXIAL WORKPIECE ARRANGER FOR ROTARY WORK HOLDERS OF CONTOUR TURNING MACHINES

[75] Inventor: Richard Holmes, Harrisville, Mich.

[73] Assignee: Dawson Carbide Industries, Inc., Warren, Mich.

[21] Appl. No.: 173,593

[22] Filed: Jul. 30, 1980

[51] Int. Cl.[3] ..... B25B 1/00

[52] U.S. Cl. ..... 269/6; 269/262; 269/283; 269/902

[58] Field of Search ..... 269/6, 902, 262, 283; 279/1 L; 82/45; 51/277

[56] References Cited

U.S. PATENT DOCUMENTS

| | | | |
|---|---|---|---|
| 1,197,785 | 9/1916 | Arnold | 51/277 X |
| 1,336,928 | 4/1920 | Simmons | 51/277 |
| 2,632,255 | 3/1953 | Mosca | 51/277 X |
| 3,256,754 | 6/1966 | Rivierre et al. | 82/45 X |
| 3,617,044 | 11/1971 | Strange | 269/6 |
| 4,222,577 | 9/1980 | Griffin | 279/1 L X |

*Primary Examiner*—Robert C. Watson

*Attorney, Agent, or Firm*—Hiram P. Settle

[57] ABSTRACT

Mounted upon the lower jaws of a gripping and manipulating tool is an obtuse-angled adapter plate to which is secured an adjustable work positioner including a stationary work-positioning V-block and a relatively movable work-positioning block provided with a work-holding recess consisting of a notch shaped to fit the edge of the workpiece to be contour ground. The stationary V-block contains a right-angled recess which is shaped to fit and become coaxially centered with respect to a centering portion of rectangular cross-section coaxial with the work-holding spindle of the contour work-turning machine such as a contour grinder. A fastener is provided for clamping the adjustable block to the stationary block and passes through a vertical slot in the adjustable block into a threaded bore in the stationary block.

5 Claims, 4 Drawing Figures

FIG. 1
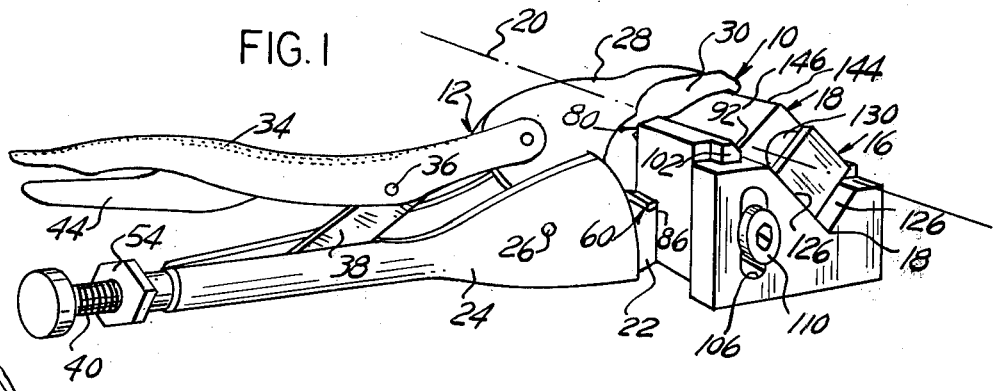
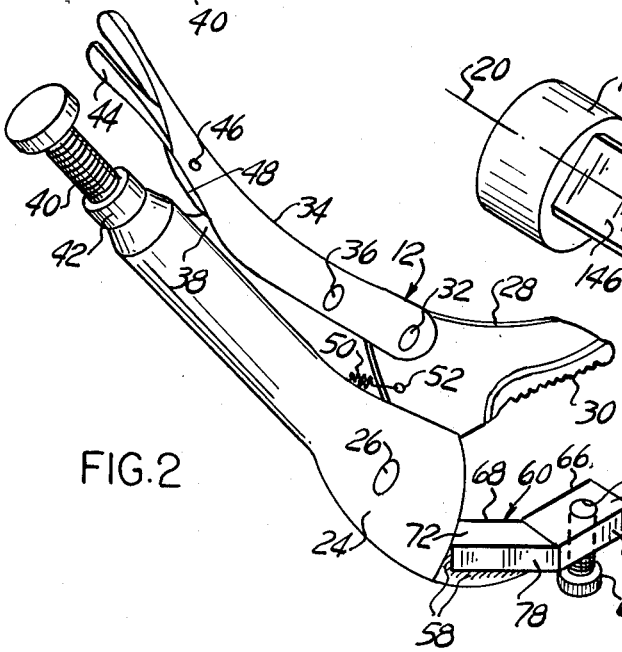
FIG. 2
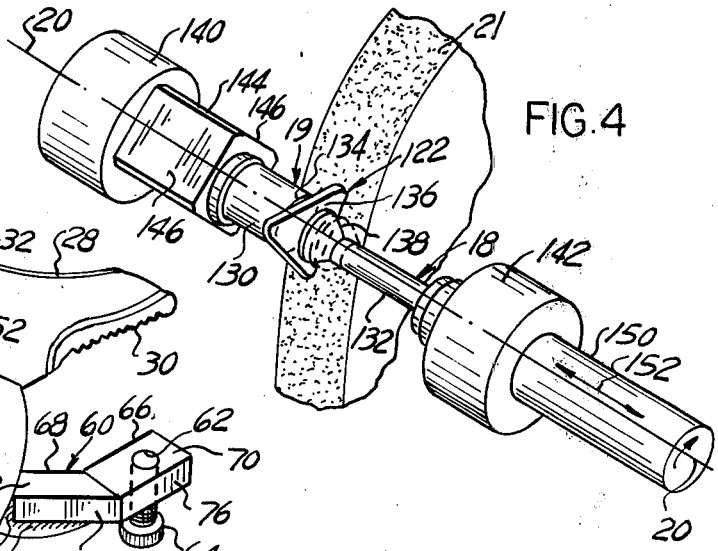
FIG. 4
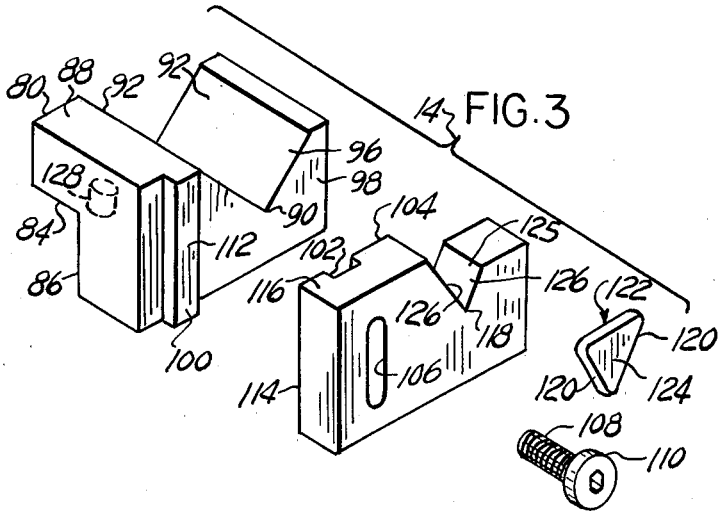
FIG. 3

COAXIAL WORKPIECE ARRANGER FOR ROTARY WORK HOLDERS OF CONTOUR TURNING MACHINES

SUMMARY OF THE INVENTION

The invention particularly resides in the work positioner including the relatively-adjustable stationary and movable blocks mounted in the gripping tool, the stationary block being adapted to fit with a mating rectangular centering portion or guide member mounted coaxial with the rotary work-holding spindle of the grinder or other contour turning machine, the adjustable block being slidably fitted in abutting engagement with the stationary block and having a work-holding recess therein for holding different sizes of similarly-contoured workpieces coaxial with the rotary work-holding spindle of the contour turning machine.

In the drawings,

FIG. 1 is a perspective view of a workpiece arranger for mounting a workpiece in the rotary workpiece holder of a turning machine, according to one form of the invention, with a rectangular workpiece positioned coaxially in the work-holding recess of the adjustable block 1

FIG. 2 is a perspective view of the gripping and manipulating tool of the work locator in its open position, showing the work positioner adapter mounted thereon;

FIG. 3 is an exploded perspective view of the work positioner shown in FIG. 1, with a triangular workpiece aligned coaxially therein, the work positioner being ready for insertion in the rotary work-holding position of the turning machine; and FIG. 4 is a perspective view of the rotary workpiece-holder of the turning machine after the triangular workpiece of FIG. 3 has been clamped therein coaxial therewith.

Referring to the drawings in detail, FIGS. 1, 2 and 3 show a coaxial workpiece locator, generally designated 10, including a gripping and manipulating tool, generally designated 12, for an adjustable workpiece positioner, generally designated 14, for a rounded-cornered rectangular workpiece 16 to be mounted in the rotary workpiece holder 18 (FIG. 4) of a contour turning machine, such as a conventional contour grinder 19 coaxial with the axis of rotation 20 of said work holder 18 adjacent its grinding wheel 21. The gripping tool 12 and contour grinder 19 are conventional and available upon the open market, and their details form no part of the present invention. One such gripping and manipulating tool is manufactured and sold by the Petersen Manufacturing Company of DeWitt, Neb. under the trademark "VISE-GRIP" wrench. For the purposes of the present invention, the gripping and manipulating tool 12 (FIG. 2) may be said to consist of a fixed jaw 22 integral with a fixed handle 24 (FIG. 2) carrying a pivot pin 26 on wich is swingably mounted a movable jaw 28 having a serrated gripping portion 30.

The movable jaw 28 is pivoted at 32 to a movable handle 34 to which is pivoted at 36 a link 38, the lower end of which (not shown) is engaged by the inner end of an adjusting thumb screw 40 threaded through a threaded collar portion 42 in the outer end of the fixed handle 24. A locking lever 44 pivoted at 46 to the movable handle 34 has an inner end portion 48 movable into and out of locking engagement with the link 38. A tension spring 50 having its forward end anchored in a hole 52 through the movable jaw 28 has its rearward end (not shown) secured within the midportion of the fixed handle 24 which, like the movable handle 34, is of U-shaped cross-section. A lock nut 54 (FIG. 1) is optionally provided for locking the adjusting screw 40 in any selected position. These constructional details of the gripping tool 12 are conventional and well known.

Secured as by welding at 58 to the lower jaw 22 of the gripping tool 12 is an adapter 60 which has a hole 62 drilled near its outer end to receive a screw 64 by which the adjustable work positioner 14 is secured to the lower jaw 22, as explained below. The adapter 60 includes outer and inner portions 66 and 68 respectively with upper surfaces 70 and 72 inclined along the vertex line 74 at an obtuse angle relatively to one another. This adapter 60 also has outer and inner side abutment surfaces 76 and 78. The adapter surface 70 thereby becomes parallel to a plane passing through the tops of the serrations of the serrated gripping portion 30 when the adjustable work positioner 18 is clamped therebetween.

The adjustable work positioner 4 (FIG. 3) which is to be grasped by the gripping tool 12 in laterally-offset relationship thereto with the aid of the adapter 60 consists generally of a stationary body or block 80 and an adjustable body or block 82 disposed in sliding abutting engagement therewith. The bottom of the stationary block 80 contains a rabbet 85 with plane horizontal and vertical side surfaces 84, 86 arranged at right angles to one another to fit and abut the adapter surfaces 70 and 76 respectively (FIG. 2). The upper surface 88 of the stationary block 80 contains a recess or groove 90 with plane surfaces 92 disposed at right angles to one another which, as will be seen below, are adapted to fit reference surfaces in connection with the turning machine work holder so as to be coaxial therewith along a central axis 96 running down the center of the recess 90. The rearward otherwise flat surface 98 of the stationary block 80 is provided with a rearwardly-projecting elongated vertical rib 100 of rectangular cross-section which is adapted to fit the correspondingly-shaped groove 102 in the forward surface 104 of the adjustable block 82 so that the blocks 80 and 82 abut one another in relative sliding engagement. The adjustable block 82 is provided with an elongated vertical slot 106 adapted to snugly receive the threaded shank 108 of a clamping screw 110, the shank 108 being adapted to be threaded into a threaded horizontal bore 112 in the rib 100. In this manner, the stationary block 80 and adjustable block 82 are relatively slidably engaged with the forward flat surface 114 of the adjustable block 82 engaging the flat rearward surface 98 of the stationary block 80 in face-to-face relationship.

The adjustable block 82 in its upper surface 116 is provided with a recess 118 such as a V-notch adapted to fit snugly the opposing edges 120 of a workpiece 122 having a center 124. The recess 118 has a central axis 125 corresponding to the central axis 96 of the recess 90 and parallel thereto. The adjustable block 82 is moved upward or downward along its rib-and-groove connection 100, 102 so that when the edges 120 of the workpiece 122 are seated in the recess 118 against the side surfaces 126 thereof, the workpiece center 124 is positioned exactly in coincidence with the axis 96 and therefore, as will be seen below, in exact coincidence with the axis of rotation of the rotary workpiece holder 18 of the contour turning machine 19 (FIG. 4). The stationary block 80 is provided with a threaded vertical bore 128 extending upward from the horizontal bottom surface 84 in alignment with the hole 62 in the adapter 60 whereby the stationary block 80, and therefore the adjustable work positioner 14, are precisely positioned and secured upon the adapter 60 by the clamping screw 64.

The rotary work holder 18 (FIG. 4) of the contour turning machine 19 consists of a fixed shaft 130 mounted coaxial with an axially-movable shaft 132 with opposing surfaces 134 and 136 respectively between which the workpiece 122 is clamped. The surface 136 is formed on an enlarged head 138 integral with the movable shaft 132. Both of the shafts 130 and 132 are rotatably mounted in bearings 140 and 142 respectively. Mounted on the fixed shaft 130 is polygonal reference member or guide member 144 coaxial with the fixed shaft 130 and having side surfaces 146 adapted to fit precisely into the recess 90 of the stationary block 80 against the mutually perpendicular side surfaces 92 thereof in mating engagement therewith in such a manner that the axis 96 of the recess 90 becomes exactly coincident with the axis of rotation 20 of the work holder shafts 130 and 132, as explained below in connection with the description of the operation of the invention. The movable shaft 132 of the work holder 18 on the opposite side of the bearing 142 continues in an enlarged portion 150 which is movable longitudinally for the insertion and removal of the workpiece 122. The description of the work holder 18 is only broadly outlined and illustrated herein because it and the rotary contour turning machine or contour grinder 19 as stated above are conventional and well-known to those skilled in the grinding and turning art. It will also be understood that the recess 118 will vary in shape according to the shape of the workpiece and the side surfaces 126 may be disposed at a larger or smaller acute angle according to the shape of the workpiece.

In FIG. 1, for example, the workpiece 16 is square whereas the workpiece 122 in FIG. 3 is rectangular with rounded corners, hence for a square workpiece 16 the surfaces 126 of the V-notch 18 would form a 90-degree angle, whereas those for a triangular workpiece 122 would of course form an angle of 60 degrees. The adjustable block 82 is also varied in its vertical position with respect to the stationary block 80 according to the variation in size of workpieces of the same shape. Thus, one adjustable work positioner 14 can be adapted quickly and easily to accommodate different sizes of workpiece of the same shapes merely by moving the adjustable block 82 upward or downward relatively to the stationary block 80 until the center 124 of the workpiece 122 coincides with the axis 96 of the stationary block 80.

In the operation of the invention, let it be assumed that the rotary work holder 18 is prepared for the insertion of workpieces by moving the workpiece holder shaft 132, 150 to the right (FIG. 4) as indicated by the right-hand head of the arrow 152, thereby creating a gap between the end surfaces 134 and 136 of the shaft portions 130 and 132 respectively. Let it be assumed that the movable and adustable block 82 has been provided with a workpiece recess 118 of the proper size and shape for the workpiece 122, for example, the acute-angled notch 118. Let it also be assumed that the adjustable block 82 has been secured to the stationary block 80 by means of the clamping screw 110 having its threaded shank 108 inserted through the elevated slot 106 into the threaded bore 112 after the rib 100 and groove 102 have been placed in mating engagement. Let it further be assumed that the stationary and movable blocks 80 and 82 thus assembled into the work positioner 14 have been mounted between the jaws 22 and 28 of the gripping tool by inserting the vertical clamping screw 64 through the vertical bore 62 (FIG. 2) of the adapter 60 into the threaded vertical bore 128 of the stationary block 80 and temporarily tightened.

Let it finally be assumed that an exact-sized and centered replica of the workpiece 16 or 122, depending on the size and shape thereof, is inserted in the notch or recess 118 in the adjustable block 82, that the latter has been moved upward or downward until the center of the workpiece replica has been made to coincide with the axis 96 of the stationary block 80, and that the horizontal clamping screw 110 has been finally tightened to clamp the stationary block 80 and adjustable block 82 together in their relatively-adjusted workpiece-centering positions.

The operator, having removed the workpiece-centering replica from the notch or recess 118, now grasps the handle 24 of the gripping and manipulating tool 12 and moves the coaxial work locator 10, thus adjusted, beneath the reference member 144 (FIG. 4) and then upward until the right-angled recess or notch 90 moves into mating engagement with the reference member 144 with the mutually perpendicular surfaces 92 precisely engaging the also mutually perpendicular surfaces 146. Meanwhile, the operator also moves the coaxial work locator 10 bodily in a horizontal direction so that the workpieces 16 or 122, as the case may be, when subsequently inserted in the notch 118, will come up into the gap between the end surfaces 134 and 136 of the work holder shafts 130 and 132.

The operator now locks the work locator 10 temporarily in this position by squeezing together the handles 34 and 24 of the gripping and manipulating tool 12, whereupon he drops an unprocessed workpiece into the notch or recess 118 in the adjustable block 118. The work locator 10 now presents the appearance shown in FIG. 1. He then moves the work holder shaft 132 axially to the left as indicated by the left-hand arrowhead of the arrow 152 so as to clamp the workpiece securely between the shaft end surfaces 134 and 136. By this procedure, since the center 124 of the workpiece 122 has been previously aligned with the axis 96 or the recess 90 of the stationary block 80, and since the axis 96 has now been brought into coincidence with the axis of rotation 20 of the rotary work holder 18, it necessarily follows that the center 124 of the workpiece 122 has been thereby placed in coincidence with the workpiece holder axis 20. The contour turning or grinding machine 19 is then started, causing the rotary work holder 18 (FIG. 4) to rotate along with the grinding wheel 20 as well as to move back and forth so that the workpiece 122 is caused to be ground or otherwise turned in accordance with the master pattern (not shown) governing the motion of the rotary work holder 18 toward and away from the contour grinding wheel 21 or rotary butter, as the case may be.

After the contour or edge grinding operation has been completed in this manner, the operator unclamps the workpiece by moving the work holder shaft 132 to the right, and then removes the workpiece 122. He thereupon replaces it with an unground workpiece in the manner described above and repeats the foregoing operation with the use of the coaxial work locator 10 in the above-described manner with each successive workpiece. If the size of the workpiece is changed but its shape remains similar, the movable or adjustable block 82 is readjusted by loosening the horizontal clamping screw 110 and sliding the adjustable block 82 upward or downward relatively to the stationary block 80 until the center 124 of the different-sized workpiece 122 is again brought into coincidence with the axis 96 of the recess 90, whereupon the clamping screw 110 is retightened and the foregoing operation repeated for the new size of workpiece. If, however, the shape of the workpiece is changed, the shape of the recess 118 is correspondingly altered as, for example, when a diamond-shaped workpiece (not shown) is to be ground.

To simplify the explanation, the workpiece has been shown in the drawing as clamped directly between the end surfaces 134 and 136 of the work holder shafts 130 and 132. As is well known to those skilled in the grinding machine art, the adjacent end portions of the shafts 130 and 132 are bored to receive the shanks of so-called removable "anvils", the exposed outer ends of which are sized and shaped to engage the maximum areas of the workpiece so as to exert the maximum gripping force on the workpiece while it is being ground, cut or otherwise processed.

I claim:

1. A locator for positioning a workpiece between a pair of separable workpiece holders so that the workpiece is interposed between the holders with its axis aligned with the axis of said holders, one of said holders having an enlarged locating portion concentric with the axis of said holders and axially spaced from the desired workpiece location, comprising a locator block having a V-shaped groove therein defined by a pair of angularly related surfaces adapted to engage the enlarged locating portion of said one holder, the pair of surfaces intersecting in an apex located a predetermined radial distance from the axis of said holders, a slide block having a V-shaped groove therein defined by a pair of angularly related surfaces adapted to engage the adjacent side surfaces of a workpiece, said surfaces intersecting at an apex, means interconnecting said locator block and said slide block and accommodating relative linear movement therebetween, the apices of the V-shaped grooves in said block being aligned in the direction of linear movement and being relatively adjustable in said direction, means for securing said blocks in an adjusted position, and means for clamping said locator block to said enlarged locating portion of said one holder, a workpiece positioned in the V-shaped groove of said slide block when said locator block is so clamped lying between said holders with the slide block being adjusted in said single direction relative to said locator block so that the axis of the workpiece as positioned in the V-shaped groove of the slide block is co-axial with the axis of said holders.

2. A locator as defined in claim 1, wherein the enlarged locating portion of said one of said holders is polygonal in cross-section and the V-shaped groove in the locator block is defined by a pair of angularly related surfaces snugly engaging adjacent sides of the enlarged polygonal locating portion.

3. A locator as defined in claim 1, wherein the workpiece is polygonal in cross-section, the V-shaped groove in the slide block engages two adjacent surfaces of the polygonal workpiece, and the slide block is adjusted in said single direction of movement relative to said locator block to accommodate the positioning of the different sizes of workpieces having the same polygonal shape, so that the axis of the workpiece coincides with the axis of the workpiece holders.

4. A locator for positioning polygonal workpieces of the same shape but of different sizes between a pair of separable workpiece holders so that the workpiece is interposed between the holders with its axis aligned with the axis of said holders, one of said holders having an enlarged polygonal portion concentric with the axis of said holders and axially spaced from the vertical end face of said one holder which defines the desired workpiece location, comprising a locator block having a groove therein adapted to receive the polygonal portion of said one holder, means for clamping the locator block on said polygonal portion, a slide block having a groove therein of a shape appropriate to abut adjacent sides of polygonal workpieces of the same shape but of different sizes, and means securing the locator block to the slide block while accommodating only relative vertical movement therebetween, so that the slide block is positioned by the locator block so that a workpiece located in the slide block groove is disposed in vertical alignment with the end face of said one holder and then adjusted vertically to position the workpiece with its axis coincident with the axis of said holders when the locator block is positioned on and clamped to the enlarged polygonal portion of said one holder.

5. A locator for positioning polygonal workpieces of the same shape but of different sizes between a pair of separable workpiece holders, the locator functioning to locate the workpiece between the holders with its axis aligned with the axis of said holders, one of said holders having a locating portion concentric with the axis of said holders and axially spaced from the desired workpiece location, comprising a locator block having a groove therein adapted to snugly receive the locating portion of said one holder, means for clamping said block on said locating portion, a slide block having a groove therein of a shape to snugly abut two adjacent sides polygonal workpieces of the same shape but of different sizes, means adjustably securing the locator block to the slide block to fixedly align the slide block groove with the space between the holders while accommodating relative movement therebetween in a single direction of movement radial to the space and with the grooves in the respective blocks aligned in said single direction of movement to accommodate adjustment of the slide block relative to the locator block to position the axis of a workpiece located in the slide block groove at a position coincident with the axis of said holders when said locator block is positioned on said locating portion of said one holder.

* * * * *